United States Patent [19]

Larkin et al.

[11] Patent Number: 4,523,691

[45] Date of Patent: Jun. 18, 1985

[54] PORT STRUCTURE FOR I.V. CONTAINER

[75] Inventors: Mark E. Larkin, Lindenhurst; Kenneth H. Knox, Vernon Hills, both of Ill.

[73] Assignee: Abbott Laboratories, North Chicago, Ill.

[21] Appl. No.: 483,392

[22] Filed: Apr. 8, 1983

[51] Int. Cl.[3] ..... B65D 33/16

[52] U.S. Cl. ..... 220/266; 604/408; 604/415; 215/249; 215/251

[58] Field of Search ..... 215/247, 249, 250, 251; 604/408, 415, 244; 220/266

[56] References Cited

U.S. PATENT DOCUMENTS

| | | | |
|---|---|---|---|
| 3,215,299 | 11/1965 | Coanda et al. | 215/100 |
| 3,364,930 | 1/1968 | Ryan | 604/244 |
| 3,392,859 | 7/1968 | Fischer | 215/247 |
| 3,915,212 | 10/1975 | Bujan et al. | 604/408 X |
| 3,938,520 | 2/1976 | Scislowicz | 215/247 X |
| 4,153,173 | 5/1979 | Ward et al. | 215/251 X |
| 4,303,067 | 12/1981 | Connolly et al. | 215/247 X |
| 4,344,472 | 8/1982 | Larkin et al. | 215/256 X |

*Primary Examiner*—Donald F. Norton

*Attorney, Agent, or Firm*—Alan R. Thiele; Martin L. Katz

[57] ABSTRACT

A port structure is provided for a container such as a flexible bag for I.V. fluids which will permit the piercing by a piercing pin in a leak resistant manner. The port structure is fabricated with the usual piercing diaphragm positioned in the innermost portion of the tubular port. Unlike the usual construction of port structures of this type, the inner tubular member containing the pierceable diaphragm is not connected to the remaining portions of the port structure at the outermost regions thereof or adjacent the flange or connecting portions, but instead joins the tubular member at an intermediary position so as to create a standing port for receiving the piercing pin.

12 Claims, 15 Drawing Figures

PORT STRUCTURE FOR I.V. CONTAINER

BACKGROUND OF THE INVENTION

This invention relates to a port assembly of the pierceable type for a flexible container. More particularly, it relates to a pierceable port structure which can receive a piercing pin in a leak resistant manner so that when the contents of the bag are placed under elevated pressures liquid will not leak around the piercing pin after the diaphragm is pierced.

Pierceable closures for containers are described in U.S. Pat. Nos. 3,215,299 and 3,392,859. In U.S. Pat. No. 3,215,299 the pierceable closure is illustrated for an I.V. container, whereas in U.S. Pat. No. 3,392,859 it is disclosed in conjunction with a container such as one containing a carbonated beverage. A recessed diaphragm in an I.V. bag port is also described in U.S. Pat. No. 3,364,930. U.S. Pat. No. 3,215,299 illustrates a pierceable port or closure structure wherein entrance to the tubular member containing the pierceable diaphragm is immediately adjacent the connection to the closure and is of a relatively thick wall structure. In U.S. Pat. Nos. 3,364,930 and 3,392,859 upwardly extending tubular members are described in a port in conjunction with a pierceable diaphragm. Again, the diaphragm portions of these particular port structures are positioned immediately adjacent the connection with the container or a heavy walled structure of the closure as in U.S. Pat. No. 3,392,859. The prior art does not afford a freestanding port structure for an I.V. container wherein the pierceable diaphragm is positioned away from the connection of the port structure to the bag or the cap structure.

It is an advantage of the present invention to afford a port structure for a container which will permit the piercing by a piercing pin yet will resist leakage when the container is under elevated pressure. Other advantages are a port structure for an I.V. solution container which is easily sealed to the standard tubular port of an I.V. container; a port structure wherein the the components can be easily molded from standard plastic resinous materials or those which are not of the standard type; a port container system which not only affords leak resistance with a piercing member but also can be utilized with an easily opened closure cap; and a container port structure which can be fabricated and applied to the container with existing equipment and in a fast and economical manner.

SUMMARY OF THE INVENTION

The foregoing advantages are accomplished and the shortcomings of the prior art are overcome by the present port structure for a container which will permit access by a piercing member in a leak resistant manner. A container port is provided by the usual tubular member. A port sealing member is positioned in the port tubular member with the port sealing member including a tubular portion, a port connecting portion and a supporting portion. The supporting portion is positioned between the connecting portion and the tubular portion and the supporting portion is secured to the tubular portion at a point spaced from the outer end of the tubular portion to hold the tubular portion in a freestanding manner away from the connecting portion. The port connecting portion is sealed to the container tubular member. A pierceable diaphragm member is operatively positioned in the tubular portion to seal the contents of the container from outside atmosphere. In a preferred manner, the portion connecting portion is provided by an outwardly extending flange member sealably engaged with the container port tubular member. In one embodiment, an inner annular member also sealably engages with the container port tubular member. The supporting portion is positioned to join the tubular portion at a point adjacent the inner end of the tubular portion. Also preferably, the tubular portion, the connecting portion and the supporting portion of the port sealing member are fabricated as an integral unit and from a flexible thermoplastic material. The port structure in effect provides a freely standing port with the diaphragm placed away from the connection of the port sealing member from the container so that upon insertion of the piercing member into the tubular port sealing member and a piercing of the diaphragm, the tubular member will tend to grip and seal around the piercing member as it is free to do so through its freestanding position. A sealing cap operatively engages the container port and the port sealing member to provide an outer sterile closure.

DESCRIPTION OF THE DRAWINGS

A better understanding of the present leak resistant port structure will be accomplished by reference to the drawings wherein.

DESCRIPTION OF THE EMBODIMENTS

Figure 2:
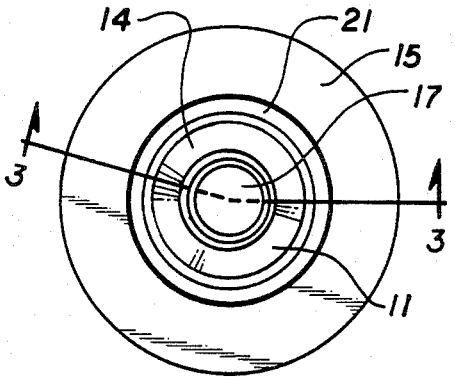
FIG. 2 is a top plan view of the port sealing member shown in FIG. 1.
Figure 3:
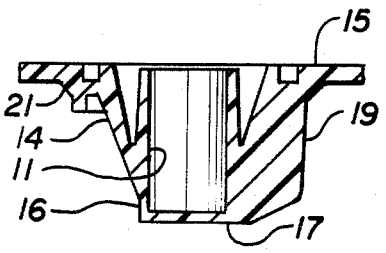
FIG. 3 is a view in vertical section taken along line 3—3 of FIG. 2.
Figure 1:
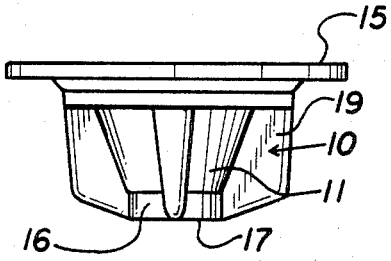
FIG. 1 is a view in side elevation of a port sealing member for use in the port structure of this invention.
Figure 5:
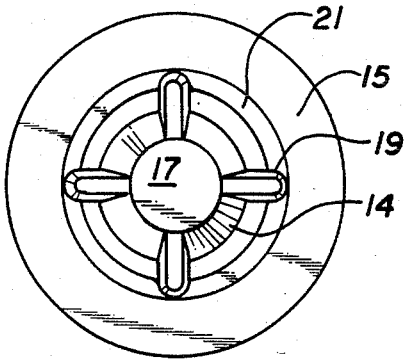
FIG. 5 is a bottom plan view of the sealing member shown in FIGS. 1–4.
Figure 4:
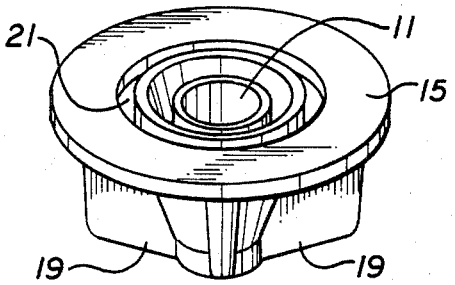
FIG. 4 is a top perspective view of the port sealing member shown in FIG. 1.

Proceeding to a detailed description of the present invention, one embodiment of the port structure is shown in FIGS. 1–8. This embodiment will include a port sealing member generally 10 having a tubular portion 11 and a supporting portion 14 extending between the tubular portion 11 and a flange or connecting portion 15 with a step section 21 therebetween. This is particularly shown in FIG. 3. Locating members 19, which are four in number, extend outwardly from the supporting portion 14 with supporting portion 14 in effect provided by a conical wall which like locating members 19 extend from flange portion 15 to a straight wall section 16 immediately adjacent pierceable diaphragm 17.

Figure 6:
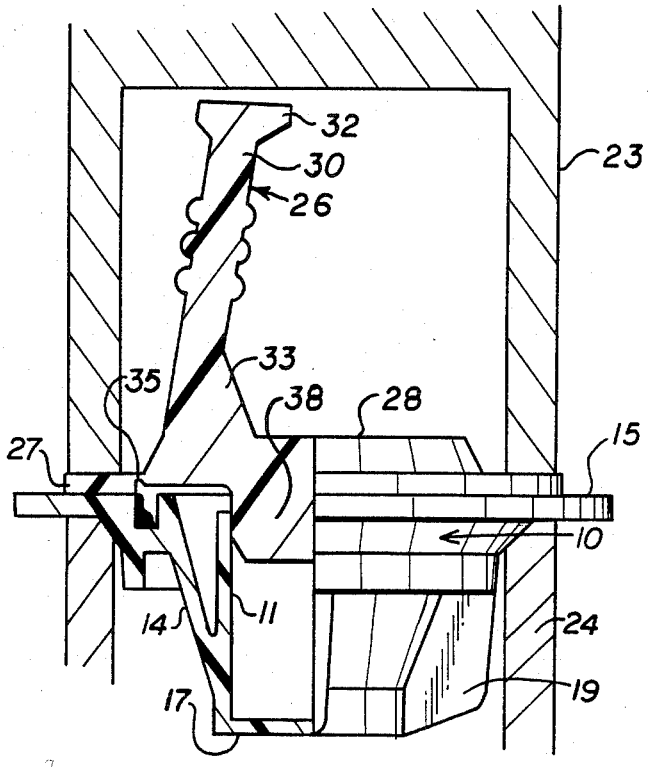
FIG. 6 is a view in side elevation diagramatically showing the sealing of a closure cap to the port sealing member.

Referring to FIG. 6, a tear-away closure, generally 26 is illustrated for use in conjunction with port sealing member 10. Closure, generally 26 is described in U.S. Pat. No. 4,344,472 and is commonly assigned. It includes a skirt 27 extending from a base portion 28. A pull member 30 extends upwardly from the base and has a head 32 and an arm 33. These elements assist in pulling the base portion 28 away from skirt 27 by means of a weakened tear path 35. Locating ribs such as 38 assist in positioning the closure inside the tubular portion 11 of port sealing member 10. The sealing of the closure 26 to the port sealing member 10 is illustrated in FIG. 6 and is accomplished by two opposing welding heads 23 and 24 which seal flange 15 of port sealing member to skirt 27 of closure 26.

Figure 7:
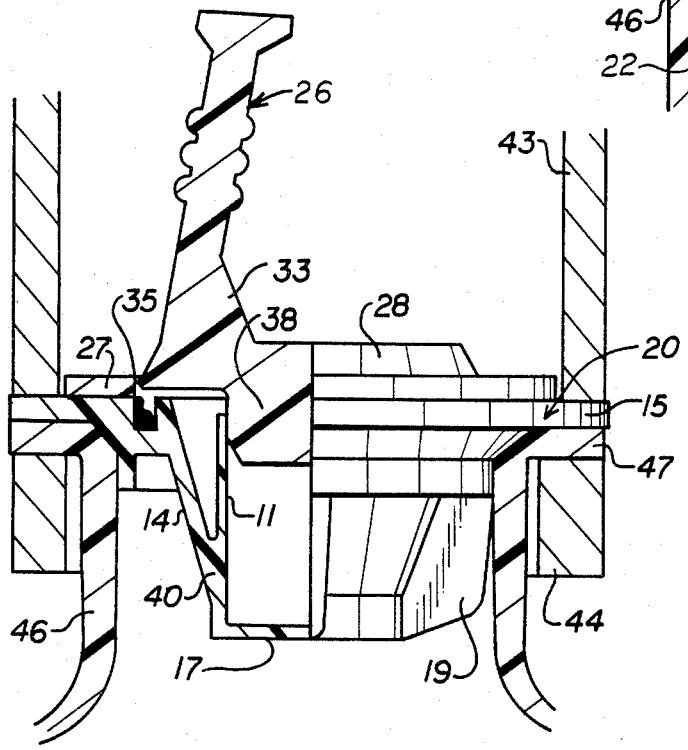
FIG. 7 is a view similar to FIG. 6 except showing the assembled closure and port sealing member of FIG. 6 sealed to a container port.
Figure 10:
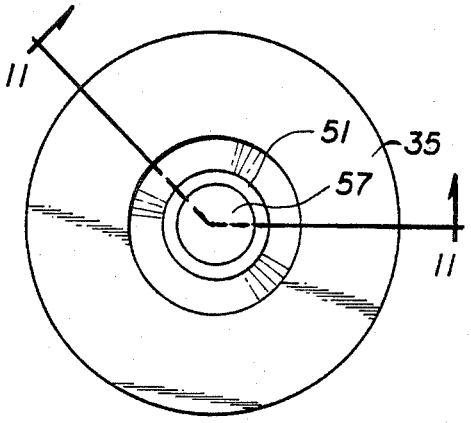
FIGS. 9, 10, 11, 12 and 13 are views similar to FIGS. 1, 2, 3, 4 and 5, respectively, except showing a modified form of the invention.
Figure 11:
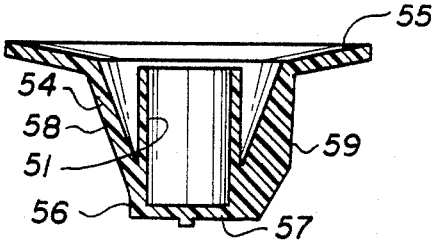
Figure 9:
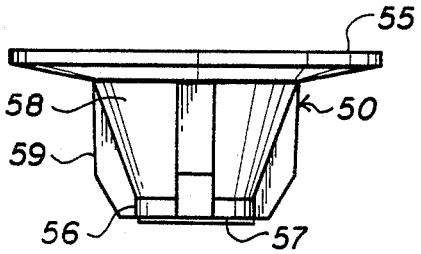
Figure 12:
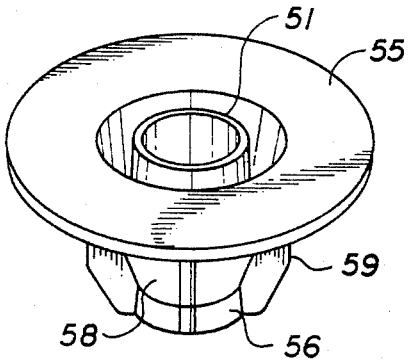
Figure 13:
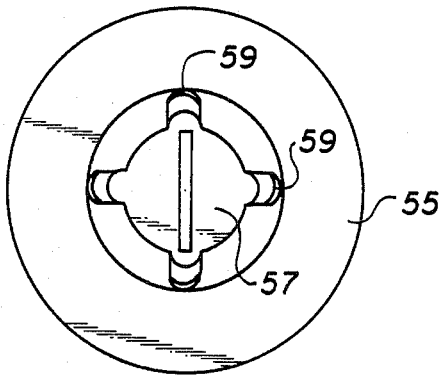
Figure 14:
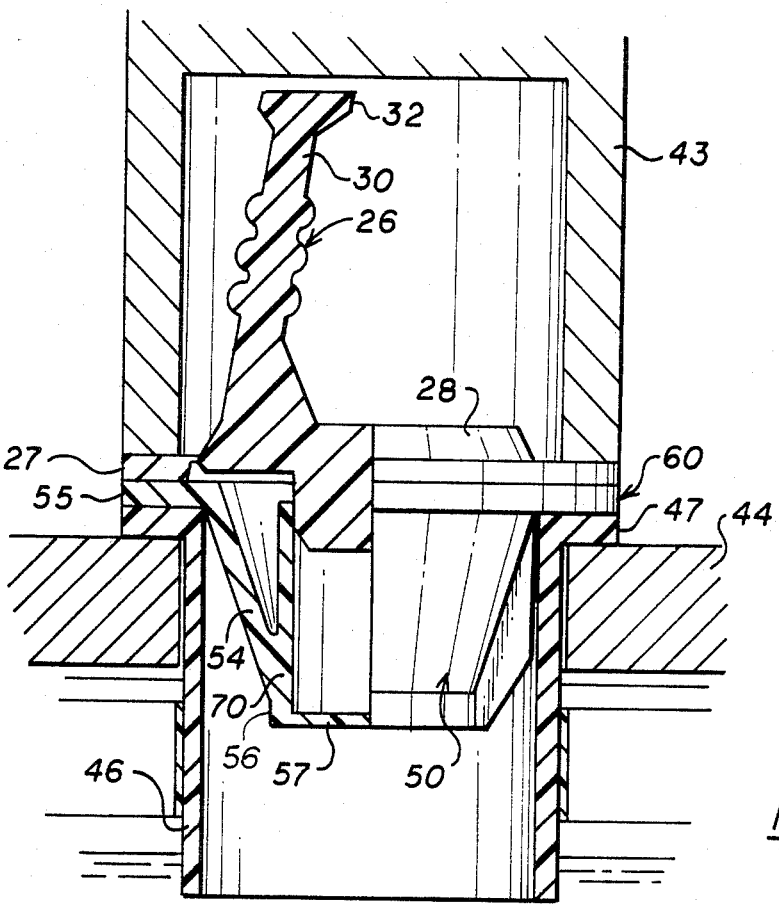
FIGS. 14 and 15 are views similar to FIGS. 7 and 8 except showing the sealing and piercing of modified embodiment of FIGS. 9–13.
Figure 15:
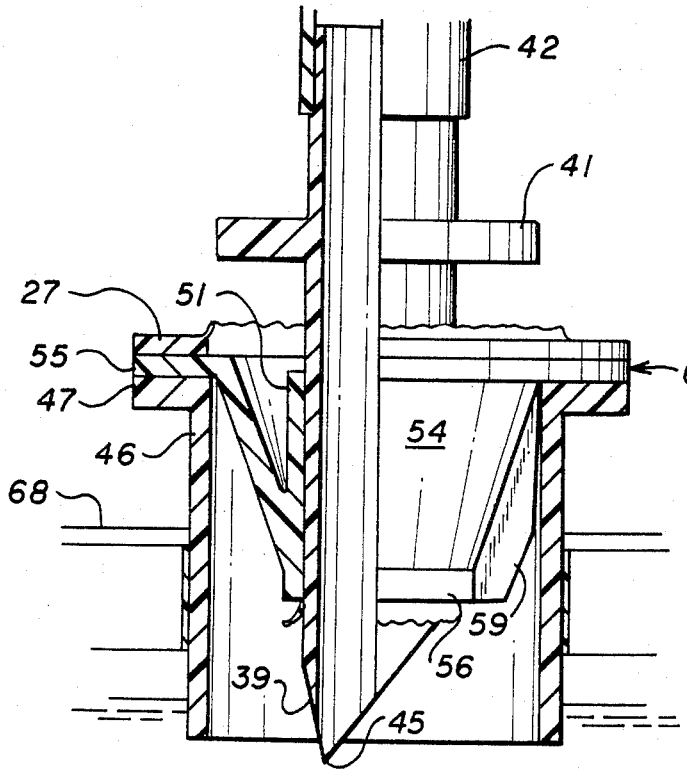

FIG. 7 illustrates the sealing of the combined sealed closure 26 and port sealing member 10 to a tubular port 46 of a flexible plastic bag 68 such as shown in FIG. 15. Two opposing welding heads 43 and 44 will seal flange 15 of port sealing member 10 to flange 47 of tubular port 46. This results in port structure generally 20.

Referring to FIGS. 9—15, an alternative embodiment is described. This particular embodiment, generally 60 (FIG. 14), will include a port sealing member generally 50 as shown in FIGS. 9–13. Port sealing member 50 as is true of sealing member 10, will have a tubular portion 51 and a flange or connecting portion 55 with a supporting portion 54 therebetween. Supporting portion 54 is formed from a straight walled portion 56 and a conical wall 58 with four locating members 59 extending therefrom. A pierceable diaphragm 57 closes one end of tubular portion 51. The major difference between port sealing member 50 and 10 is that there is no step section such as 21 placed between supporting portion 54 and flange portion 55. This step section 21 will provide an inner annular member 22 sealed to bag port 46.

Another difference between the two embodiments 20 and 60 is in the fabrication of the port sealing member 50 and closure 26 to an I.V. bag 68. It will be noted with reference to FIG. 14 that closure 26 is the same as previously described in conjunction with embodiment 20 with the same reference numerals being employed. It is placed over port sealing member 50 so that flange 27 is aligned with flange 55. These two flanges are in turn aligned with flange 47 of the bag port 46. Welding heads 43 and 44 will supply the energy to seal these three flanges together to result in the port structure 60.

Operation

Figure 8:
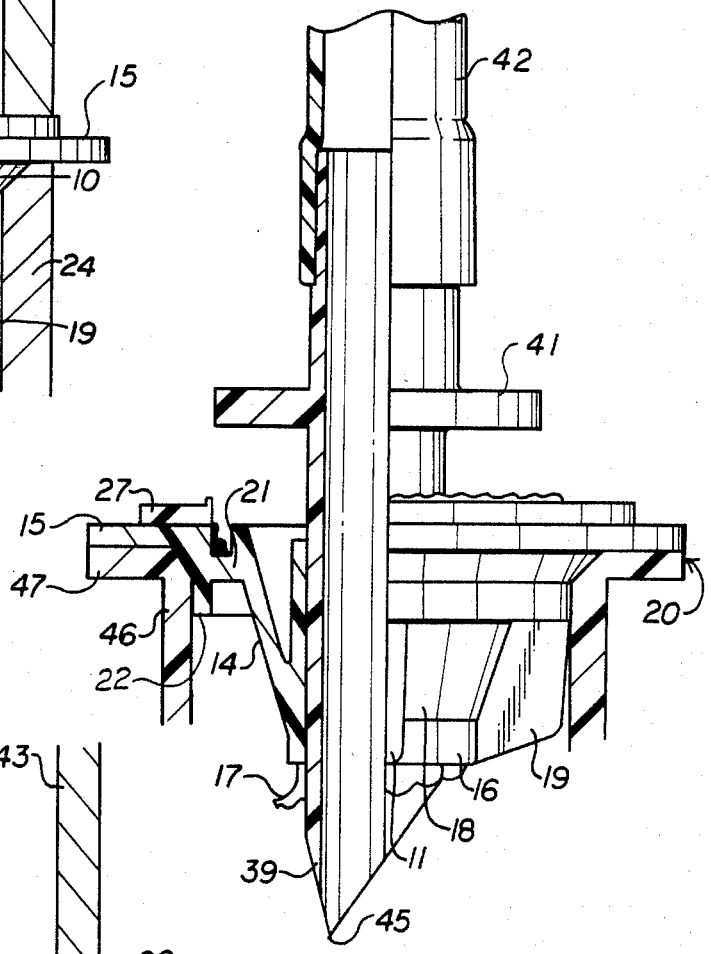
FIG. 8 is a view in side elevation and partially in vertical section illustrating the piercing of the leak resistant port structure by a piercing pin member.

A better understanding of the advantages of port structures 20 and 60 will be had by a description of their operation. As both embodiments operate in substantially the same manner, only the use of port structure 20 will be described. It will be appreciated that port structure 46 will be formed as an integral part of an I.V. container bag 68 (FIG. 15), the liquid contents of which will be placed under elevated pressure such as a standard pressure cuff. When it is desired to connect piercing pin 39 with associated tubing 42 to the bag, the base 28 of closure 26 will be removed such as by pulling upwardly on arm 33 to cause a tearing around weakened tear path 35. Spike point 45 will then be directed into tubular portion 11 and pierce through the pierceable diaphragm 17. Piercing pin 39 will assume a position in conjunction with the port structure as shown in FIG. 8 with point 45 moved past diaphragm 17 and flange 41 placed a short distance above the port structure 20. The contents of the bag will be delivered in the usual manner with standard I.V. components interconnected to tubing 42. As indicated earlier, an important feature of this invention is that the wall surface of tubular portion 11 is sealed tightly against the outer wall surface of the piercing pin 39. This is accomplished in the port structures of this invention in having the supporting portion 14 secured to the tubular portion 11 at a point spaced from the outer end of the tubular portion to hold the tubular portion in a freestanding manner and away from the connecting portion. This point of attachment or conjunction of the support portion 14 and the tubular member 11 is illustrated by the numeral 40 in embodiment 20 and 70 in embodiment 60. It should be pointed out that if the piercing diaphragm 17 were to be placed directly adjacent the connecting portion 15 of the port structure the tubular member would not have the flexibility to move with the piercing pin and to grip it in a sealing manner. Instead it would assume a more rigid position with portions of the wall tending to bend away from the surface of the piercing pin to thereby cause a leakage therearound.

Port structures 20 and 60 have been described for use in conjunction with a particular type of tearaway cap 26. It should be pointed out that this particular cap structure is not essential and any easily removable protective cap could be employed as long as it provides a sterile seal for the inner port sealing member. Port sealing member 10 is composed of a thermoplastic material such as a polyester whereas port sealing member 50 is formed from an injection molded polyvinylchloride resinous material. While these materials are preferred for the disclosed embodiments any resinous plastic material which can be easily injection molded and sealed in the manner described could be employed so long as they are compatible with sealing to the port of an I.V. solution container.

In the present invention the preferred sealing method for securing cap 26 to port sealing members 10 and 50 is R. F. welding. However, other sealing methods such as heat welding could be utilized depending upon the type of plastic materials employed for the various components.

It will thus be seen that through the present invention there is now provided a port structure for an I.V. solution container which is easily fabricated and sealed to the container and yet will reduce leakage in a container with elevated pressures. The port structure can be fabricated from existing materials and existing equipment so that it can be applied in the highly automated equipment. A leak resistant port structure for a piercing pin is provided without additional cost and yet will afford a sterile port structure.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

What is claimed is:

1. A port structure for a container which will permit access by a piercing member in a leak-resistant manner comprising:

a container port defined by a tubular member;

a port sealing member positioned in said port tubular member, said port sealing member including a movable tubular portion, a port connecting portion and substantially linear flexible supporting portion, said substantially linear flexible supporting portion positioned between said connection portion and said movable tubular portion, said substantially linear flexible supporting portion secured to said movable tubular portion and connected to said movable tubular portion at a point spaced from the outer end of said movable tubular portion to form an acute angle therewith and in a manner to hold said movable tubular portion in a freestanding manner away from said connecting portion, said connecting portion sealably engaged with said container port tubular member whereby movement of said movable tubular portion is provided by the flexing of said flexible supporting portion;

a pierceable diaphragm member operatively positioned in said movable tubular portion at the end of said movable tubular portion positioned innermost in said container port to seal the contents of said container from outside atmosphere;

a plurality of locating members extending outwardly from said substantially linear flexible supporting portion to position said port sealing member in said container port tubular member; and a sealing cap operatively connected to said container port.

2. The port structure for a container as defined in claim 1 wherein said port connecting portion is defined in part by an outwardly extending flange member sealably engaged with said container port tubular member.

3. The port structure for a container as defined in claim 1 wherein said port connecting portion is defined in part by an outwardly extending flange member and an inner annular member sealably engaged with said container port tubular member.

4. The port structure for a container as defined in claim 1 wherein said substantially linear flexible supporting portion is positioned to join said movable tubular portion at a point adjacent the inner end of said movable tubular portion.

5. The port structure for a container as defined in claim 1 wherein said movable tubular portion, said port connecting portion and said substantially linear flexible supporting portion of said port sealing member are fabricated as an integral unit.

6. The port structure for a container as defined in claim 5 wherein said port sealing member is formed from a flexible thermoplastic material.

7. A leak resistant port structure for a flexible I.V. container which is pierceable by a piercing member in a leak-resistant manner and easily opened by a tear away cap comprising:

a container port defined by a tubular member;

a port sealing member positioned in said port tubular member, said port sealing member including a movable tubular portion, a connecting portion and a substantially linear flexible supporting portion, said substantially linear flexible supporting portion positioned between said connecting portion and said movable tubular portion, said substantially linear flexible supporting portion secured to said movable tubular portion at a point spaced from the outer end of said movable tubular portion to form an acute angle therewith and to hold said movable tubular portion in a freestanding manner away from said connecting portion whereby movement of said movable tubular portion is provided by a flexing of said flexible supporting portion;

said port connecting portion sealingly engaged with said container port tubular member;

a pierceable diaphragm member operatively positioned in said movable tubular portion at the end of said movable tubular portion positioned innermost in said container port to seal the contents of said container from outside atmosphere;

a plurality of locating members extending outwardly from said substantially linear flexible supporting portion to position said port sealing member in said container port tubular member;

a pull-away cap member sealed to said port sealing member, said cap member including:

a base portion closing said port sealing member and sealed thereto;

means defining a weakened tear path to provide removal of a section of said base portion; and a pull member extending away from said base portion and constructed and arranged to effect a tearing away of said section of said base portion.

8. The leak-resistant port structure for a flexible I.V. container as defined in claim 7 wherein said port connecting portion is defined in part by an outwardly extending flange member sealably engaged with said container port tubular member.

9. The leak-resistant port structure for a flexible I.V. container as defined in claim 7 wherein said port connecting portion is defined in part by an outwardly extending flange member and an inner annular member sealably engaged with said container port tubular member.

10. The leak resistant port structure for a flexible I.V. container as defined in claim 7 wherein said substantially linear flexible supporting portion is positioned to join said movable tubular portion at a point adjacent the inner end of said movable tubular portion.

11. The leak resistant port structure for a flexible I.V. container as defined in claim 7 wherein said movable tubular portion, said port connecting portion and said substantially linear flexible supporting portion of said port sealing member are fabricated as an integral unit.

12. The leak-resistant port structure for a flexible I.V. container as defined in claim 11 wherein said port sealing member is formed from a flexible thermoplastic material.

* * * * *